US006701703B2

(12) United States Patent
Patrick

(10) Patent No.: US 6,701,703 B2
(45) Date of Patent: Mar. 9, 2004

(54) HIGH PERFORMANCE YARNS AND METHOD OF MANUFACTURE

(76) Inventor: Gilbert Patrick, 700 S. Railroad Ave., Kings Mountain, NC (US) 28086

( * ) Notice: Subject to any disclaimer, the term of this patent is extended or adjusted under 35 U.S.C. 154(b) by 129 days.

(21) Appl. No.: 10/037,257

(22) Filed: Oct. 23, 2001

(65) Prior Publication Data

US 2003/0074879 A1 Apr. 24, 2003

(51) Int. Cl.[7] ..... D02G 3/12; D02G 3/18; D02G 3/36

(52) U.S. Cl. ..... 57/229; 57/211

(58) Field of Search ..... 57/200, 210, 211, 57/224, 225, 226, 229, 230, 231, 236, 237, 238, 240, 243, 244, 249, 252, 255, 256

(56) References Cited

U.S. PATENT DOCUMENTS

| | | | | | |
|---|---|---|---|---|---|
| 2,783,609 | A | | 3/1957 | Breen | 57/140 |
| 3,729,920 | A | | 5/1973 | Sayers et al. | 57/144 |
| 3,828,544 | A | * | 8/1974 | Alker | 57/210 |
| 4,225,442 | A | * | 9/1980 | Tremblay et al. | 210/497.1 |
| 4,304,811 | A | | 12/1981 | David et al. | 428/225 |
| 4,381,639 | A | | 5/1983 | Kress | 57/229 |
| 4,384,449 | A | | 5/1983 | Byrnes, Sr. et al. | 57/210 |
| 4,838,017 | A | * | 6/1989 | Kolmes et al. | 57/210 |
| 4,936,085 | A | | 6/1990 | Kolmes et al. | 57/229 |
| 4,967,548 | A | | 11/1990 | Fangeat et al. | 57/224 |
| 5,035,111 | A | | 7/1991 | Hogenboom et al. | 57/224 |
| 5,070,540 | A | | 12/1991 | Bettcher et al. | 2/2.5 |
| 5,119,512 | A | | 6/1992 | Dunbar et al. | 2/167 |
| 5,177,948 | A | | 1/1993 | Kolmes et al. | 57/229 |
| 5,442,815 | A | | 8/1995 | Cordova et al. | 2/161 |
| 5,492,758 | A | * | 2/1996 | Baggett et al. | 428/362 |
| 5,514,457 | A | | 5/1996 | Fels et al. | 428/229 |
| 5,555,716 | A | * | 9/1996 | Dugan | 57/224 |
| 5,568,657 | A | | 10/1996 | Cordova et al. | 2/167 |
| 5,579,628 | A | | 12/1996 | Dunbar et al. | 57/246 |
| 5,644,907 | A | | 7/1997 | Kolmes et al. | 57/230 |
| 5,721,179 | A | | 2/1998 | Shi et al. | 442/203 |
| 5,845,476 | A | | 12/1998 | Kolmes | 57/229 |
| 5,853,885 | A | | 12/1998 | Prickett | 428/401 |
| 6,254,988 | B1 | * | 7/2001 | Zhu et al. | 428/373 |
| 6,363,703 | B1 | * | 4/2002 | Kolmes | 57/210 |
| 6,381,940 | B1 | * | 5/2002 | Kolmes et al. | 57/245 |
| 6,405,519 | B1 | * | 6/2002 | Shaikh et al. | 57/210 |
| 6,425,237 | B1 | * | 7/2002 | Greifeneder et al. | 57/211 |
| 6,532,724 | B2 | * | 3/2003 | Patrick | 57/229 |

FOREIGN PATENT DOCUMENTS

| | | | |
|---|---|---|---|
| EP | 0445 872 B1 | 12/1996 | D02G/3/12 |
| WO | WO 97/25464 | 7/1997 | D02G/3/04 |

OTHER PUBLICATIONS

"Standard Test Method for Measuring Cut Resistance of Material Used in Protective Clothing", *American Society for Testing and Materials*, F1790–97, pp. 1–6.

Olson, et al., "Investigation of Fabric Cut Resistance", Final Report of Phase I for Allied–Signal Technologies, Georgia Institute of Technology, Dec. 1989.

"Spectra High Performance Fibers for Protective Clothing," Allied Fibers, not dated.

"Spectra Fibers", http://polymers.alliedsignal.com/performance_fibers/products/spectra.html.

* cited by examiner

*Primary Examiner*—John J. Calvert
*Assistant Examiner*—Shaun R Hurley
(74) *Attorney, Agent, or Firm*—Womble Carlyle Sandridge & Rice, PLLC

(57) ABSTRACT

A yarn is provided which includes a core and a wrapping yarn wound about the core. The core may include glass, metal and carbonaceous fibers which may be roughened and/or stretch-broken. The yarn may exhibit enhanced performance properties, such as strength, cut resistance and heat resistance. A method of making the yarn includes combining a glass filament and metal filament in a core wrapped by a sheath.

44 Claims, 6 Drawing Sheets

HIGH PERFORMANCE YARNS AND METHOD OF MANUFACTURE

FIELD OF THE INVENTION

The present invention relates to fabrics, yarns and processes for making yarns. In particular, the present invention relates to yarns having an internal core encased in an outer fiber, and a process of spinning fibers about a core to form yarns displaying desirable performance characteristics, such as enhanced strength and cut-resistance.

BACKGROUND

It has been known in the textile field to combine certain fibers and filaments to form yarns and fabrics with enhanced physical properties, such as cut-resistance, strength and fire-resistance.

These yarns may be referred to as high performance yarns due to the physical properties expected from them. Conventional high performance yarns generally include cores, formed from one or more fibers, wrapped with one or more additional fibers. Materials used to form the cores of known high-performance yarns have included, among others, certain glasses, metals and polymeric materials. Likewise, known wrapping fibers generally include certain metals and polymeric materials. Unfortunately, most of these conventional high performance yarns fail to exhibit the optimum combination of economy and performance necessary to make them both useful and cost efficient. Due to the nature of the materials used in conventional high performance yarns and the performance characteristics expected therefrom, these yarns often suffer from time-consuming production methods and less than optimum performance characteristics. Consequently, there is a continuing need for alternative high performance yarns and fabrics.

Furthermore, it is known in the knitting industry that an unbalanced yarn, or a yarn with a high degree of twist, will cause torqueing in a finished fabric. As a result of this phenomenon, yarns having a low degree of twist, usually in the range of about 2.4 to about 3.5 twist multiple, typically are used in knitted fabrics. Conventional spinning processes also generally impart a clockwise, or Z direction, twist to a yarn. As a result, if a Z twist yarn having a high twist multiple, was incorporated into a knitted fabric product such as a glove, then the fingers of the glove would tend to torque in a clockwise, or Z, direction. When the use of high twist multiple yarns is necessary or cannot be avoided, conventional methods of avoiding such unwanted torqueing of the finished fabric include producing balanced yarns by bundling two or more Z twist yarns together and then twisting the bundles in the S direction to a balanced state. Since high performance yarns are often incorporated into garments, such as gloves, wherein torqueing would adversely affect not only the appearance but also the performance of the garment, it is desirable to provide a high performance yarn that tends not to cause torqueing in the garment in which it is incorporated.

SUMMARY

The present invention includes, among other aspects, yarns and fabrics exhibiting enhanced performance characteristics, such as cut-resistance, and methods of making such yarns. The yarns of the present invention include an inner core with a sheath applied thereto. The yarn cores of the present invention may be formed from one or more filaments or fibers containing materials that impart desired performance characteristics and/or economy to the overall yarn. Likewise, the yarn sheathes of the present invention also may be formed from one or more fibers containing materials that impart desired performance and/or economy to the yarn The fibers or filaments forming the core and/or the sheath may be processed, such as by roughening and/or stretch-breaking and/or S twisting, in order to improve the performance of the final yarn or fabric.

One embodiment of the present invention includes a yarn having both a core that includes one or more glass filaments contacted with one or more metal filaments and a sheath applied to the core. The sheath will include a series of fibers wrapped about the core. The glass or other synthetic material filaments of the core may be either roughened and/or stretch-broken. Roughening of the glass filaments increases the coefficient of friction for any such filaments, thereby reducing the likelihood that the sheath fibers or filaments combined therewith will slide along the core, but instead will tend to be engaged or gripped by the core to reduce risk of gaps and exposure of the core. Stretch-breaking of a fiber or filament tends to enhance both the cut-resistance and feel of the fabric into which it is incorporated. The sheath fibers that are wrapped about the core may also be stretch-broken, and may include various types of polymeric fibers, carbon-based fibers, or fibers having metallic properties or characteristics selected in order to impart the desired performance characteristics to the resultant fabric formed from the yarn.

Another embodiment of the present invention includes a yarn having a core formed of one or more roughened or pitted metal filaments contacted with one or more other synthetic filaments and a sheath applied to the core. The synthetic filaments included in the core can provide improved static dissipation properties and may also be roughened and/or stretch-broken.

Methods of forming yarns of the present invention are also provided. One embodiment of the method of the present invention includes contacting a glass filament with a metal filament to form a core and wrapping the core with a sheath formed of one or more fibers. The method of producing yarns may also include roughening at least the glass filament of the core. Additional fibers, including carbon-based fibers and/or various polymeric fibers may be contacted with at least one of the glass filament and the metal filament in the core. Such additional fibers may also be stretch-broken and/or roughened and as an additional step, at least a portion of the yarn also can be melted. This melting of at least a portion of the composite yarn generally can generate a consolidated mass within the yarn by transforming one or more of the yarn fibers into an amorphous mass that may partially coat other fibers of the yarn.

In another embodiment of the method of forming yarns of the present invention includes contacting a metal filament with a synthetic fiber to form the yarn core, and wrapping the core with a sheath formed of one or more fibers. As with the above methods and alternatives, one or more filaments or fibers of the core and sheath of the yarn may be roughened, stretch-broken, and/or twisted in the S direction in order to provide desired performance characteristics.

In still a further embodiment, the composite high performance yarn of the present invention is formed from multiple plies including a first ply with a glass filament core, a second ply with a metal filament core and an additional ply. The additional or third ply can include a material such as an aramid, para-aramid, high density polyethylene, polypropylene, polyester, polyamide or other high performance polymeric material or can be formed from a natural or synthetic filler material. The multiple plies are each wrapped with a series of sheath fibers and then twisted together, typically with an S-twist, to form a multi-ply core. Alternatively, a first ply having a combined glass and metal core can be combined with a high performance, cut resistant filament or a filler filament, or both with each core yarn wrapped with a protective sheath and then twisted to form a yarn bundle. These and other of the aforementioned aspects of the methods of forming yarns may be incorporated herein.

These and other features, aspects, and advantages of the present invention will become more apparent upon review of the detailed description set forth below when taken in conjunction with the accompanying drawing figures, which are briefly described as follows.

DETAILED DESCRIPTION

In general, the present invention is directed to the economical formation of high performance spun yarns, such as the embodiments shown FIGS. 1–3, 7 and 8, which yarns generally exhibit properties such as enhanced cut-resistance and strength. Some of the embodiments of the present invention, including those shown in FIGS. 1–3, 7 and 8, contain within their cores a plurality of filaments formed from different materials. These materials cooperate to impart useful performance properties in an economical manner to the finished yarns. These performance properties may then be imparted to fabrics made of such yarns and the garments formed therefrom. In general, the yarns of the present invention are designed to be produced using a conventional "Dref" or other type spinning frame and spinning process without requiring additional wrapping steps or cable twisting of sheath yarns about the multifilament core.

The finished yarns formed by these processes further generally are able to endure the mechanical and physical abuses of a knitting machine without sustaining physical damage during knitting or weaving of the yarns into fabrics. The resultant high performance yarns typically will be woven or knitted into fabrics having greatly enhanced properties, such as strength, cut-resistance and heat-resistance. These fabrics can then be used in forming protective garments such as protective gloves, outer wear such as firefighters' coats, or a variety of other type of garments and articles for which a high cut resistance and enhanced strength, and possibly other properties such as enhanced heat resistance, are necessary or desired. The high performance yarns of the present invention can also be used in fiber optics and industrial webbing and belting applications.

Figure 1:
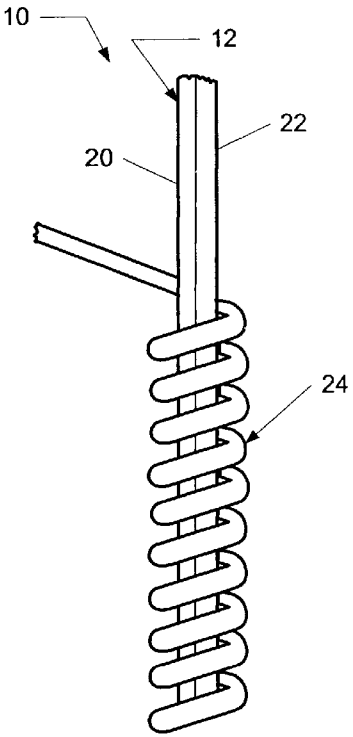
FIG. 1 is a side view of a section of a partially formed yarn that embodies the principles of the present invention.

FIG. 1 shows one embodiment of a yarn 10 encompassing the principles of the present invention. The yarn 10 includes a core 12 wrapped in a sheath 24. The core includes one or more glass filaments 20 and one or more metal filaments 22. The glass filament(s) 20 may include any suitable inorganic or organic glass or fiberglass material. Likewise, the metal filament(s) 22 may be formed from any suitable metal, such as, for example, steel, stainless steel, aluminum, copper, bronze, alloys thereof and the like. Typically, the glass filament 20 will vary in thickness from between about 50 denier to about 1200 denier twisted or untwisted, while the metal filament 22 generally can vary in thickness from between about 50 denier to about 5,000 denier twisted or untwisted, greater or lesser thicknesses also can be used for the glass and metal fibers as desired or needed depending upon the application. As indicated by these ranges, the metal filament 22 may be significantly finer than the other core filaments and still impart desired performance and cost characteristics to the yarn.

Figure 3:
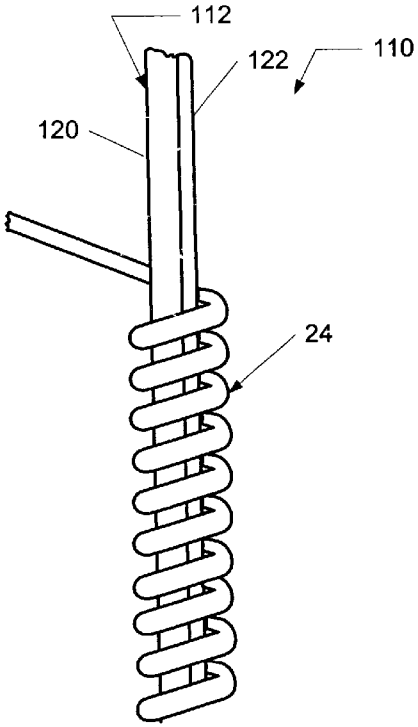
FIG. 3 is a side view of a section of another partially formed yarn including core filaments of varied thickness.

As shown in FIG. 3, another embodiment of the yarn 110 of the present invention is shown with a metal filament 122 that is significantly finer than the glass filament 120 of the core 112. The sheath 24 is, nevertheless, similar to that sheath of the embodiment shown in FIG. 1. Referring back to FIG. 1, the core 12 may have a mass ratio of approximately 5% to about 55% or more to the sheath 24. The sheath 24 may be formed from one or more fibers including materials selected from aramids, acrylics, melamine resins such as Basofil®, modacrylics, polyesters, polypropylenes, liquid crystal polyester, nylons, cellulosics, polybenzimidazole (PBI), high density polyethylene, such as SPECTRA®, silica, and polyamides, carbon fibers, wool, graphites, co-polymers and blends thereof. The cellulosic material used may include, among others, rayon, cotton, flax, jute, and blends thereof. Examples of aramids used in the core and/or the sheath include, among others, Kevlar® and Nomex® fibers. Graphites and other carbon-based fibers and fibers incorporating various metallic properties can be used in the sheath and/or core to impart electrical dissipating characteristics to the yarn. Indeed, a particular core and/or sheath fibers or filaments generally can be selected based upon desired cut and/or heat resistancy characteristics desired for the finished knitted or woven fabric product. The sheath material further typically provides a softer feel and finish and enables dying of the resultant composite yarns, and also provides better adhesion for composites.

The fibers used in the sheath 24 may range in length from about 0.5 inches to about 6.0 inches in length. Generally, the total weight characterized in yarn count for the finished yarn will be between about 35 Tex and about 1,000 Tex. Although FIGS. 1–3, 7 and 8 show sheaths formed of only one fiber, the sheath may be formed of more than one fiber or yarn and can include various types of materials. Furthermore, although the sheaths shown in FIGS. 1–3, 7 and 8 show spacing between each turn of the wrapping fiber, for clarity, it generally will be understood that the present invention encompasses wrapping turns of varying snugness, from sheaths in which each turn is compressed against the adjacent turns to those where the turns are adjacent but are not in overlapped or lightly engaging contact. Generally, the extent or tightness of the winding or wrapping of the sheath fibers about the core yarn or fibers is varied as needed to ensure and maintain complete coverage of the core fibers with the potential for gapping and/or slipping of the sheath fibers.

Figure 2:
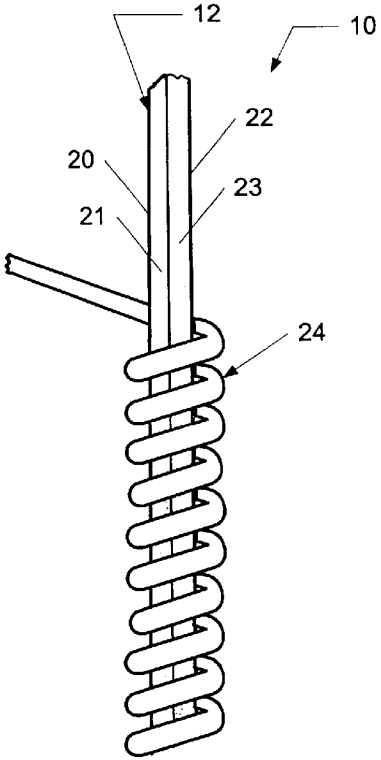
FIG. 2 is a side view of a section of another partially formed yarn embodying the principles of the present invention, wherein the core filaments are roughened.

As shown in FIG. 2, the glass filaments 20 of the core 12 of the yarn 10 also may be formed with roughened or textured portions. Such roughening of the core filaments or the use of textured filaments in the core increases the coefficient of friction, static and/or kinetic, of the filament (s); thereby increasing grip between the core and sheath fibers and reducing the frequency of slippage of the sheath fibers along the core. Slippage of the sheath fibers can expose portions of the core filaments, thereby potentially leading to contact with or damage to the core and to a rougher hand or feel or finish for the fabric incorporating the yarn. In addition, other textured or roughened filaments, other than glass, such as aramids, high density polyethylenes, nylons, polyesters, polypropylenes, polyethylenes, and/or other high performance, cut resistant yarns also can be used with the metal filaments of the core. Further, while not typically used, it is also possible to roughen the metal filaments instead of or in addition to the glass or other roughened or textured filaments of the core.

The surfaces of the glass or other filaments 20 and 22 may be roughened, as shown by the striations 21 and 23, by mechanical and/or chemical means. Mechanical abrasion of a core filament may include contacting the filament with a roughening mechanism, such as, for example, a stream of sand or similar abrasive particles, such as in sand blasting, and/or an abrasive medium, such as steel wool, sand paper, glass wool and the like. Chemical abrasion of a core filament may be accomplished by exposing the filament to a chemical agent, such as an appropriate acid, which reacts with and mars the surface of the filament. Such a chemical agent can be applied by spraying the agent over the filament or fibers, or by passing the core filament through a chemical bath, or other application techniques as will be understood by those skilled in the art.

Figure 4:
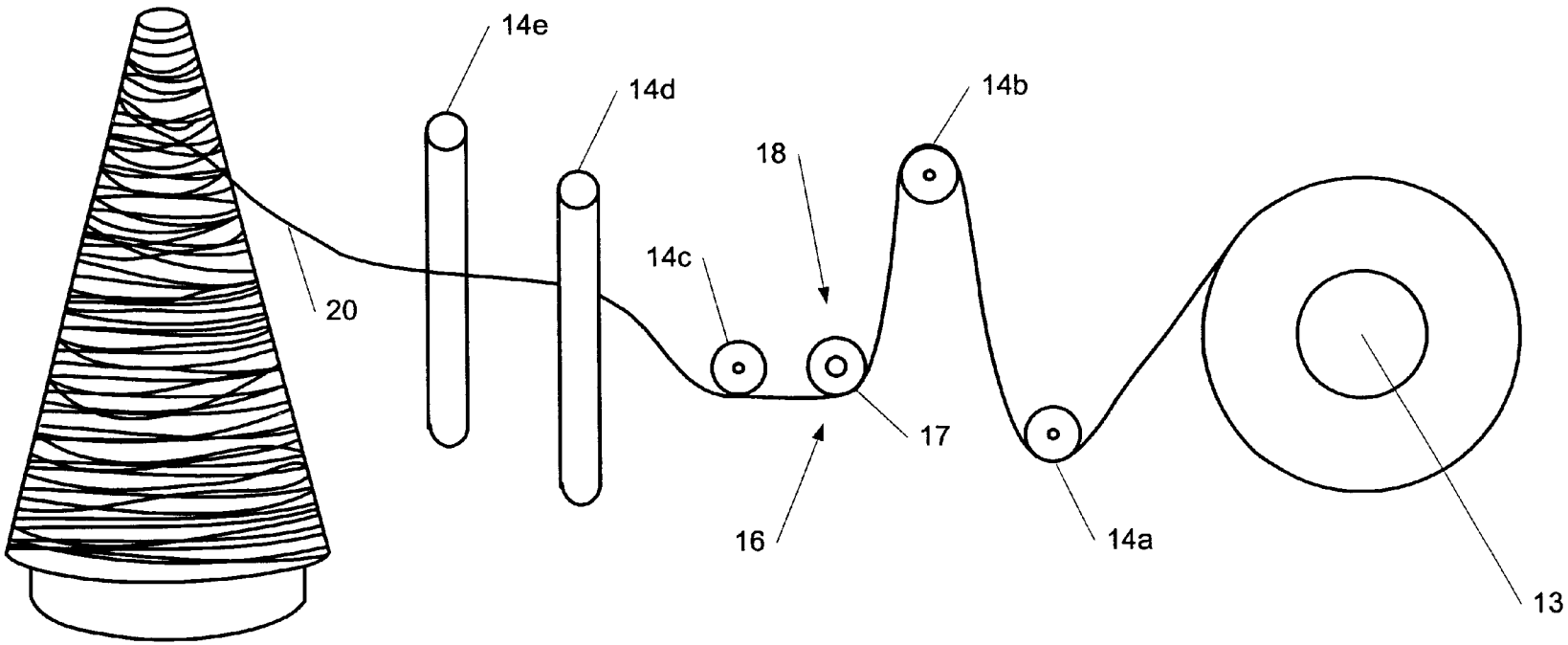
FIG. 4 is a side view of an assembly for producing a portion of a yarn that embodies the principles of the present invention, wherein a glass filament is roughened.

As shown in FIG. 4, one example embodiment of the system and method of roughening of, for example, the glass filament to be used in the core of a yarn includes transferring the glass filament 20 from the pin or bobbin roll 13 upon which it is shipped, to the spinning zone of a spinning frame, with the glass filament 20 passing through a series of guides 14A–E as it is transferred. The spinning frame may be a Dref-2, Dref-3, Dref 2000, Dref-3000, Airjet, conventional ring spinning frames or similar type spinning frame. Each of the guides generally will comprise a roller or bar typically made from or coated with a ceramic material to protect the guides and to prevent damage to the glass filament 20 as it passes over and around the guides. The number and spacing of the guides can be varied as desired in order to adjust the tension and to control the feed of the filament 20.

As indicated in FIG. 4, a roughening mechanism or assembly 16, here illustrated as including a roughening roller 17, generally is mounted between the guides along the path of travel of the glass filament 20 from its pern or bobbin 13 to the spinning frame. Generally, the mechanism such as the roughening roller 17 is positioned so that the glass filament 20 passes thereabout at approximately a 90° angle, although various other angles may be employed and are also contemplated. The roughening roller(s) typically is wrapped or covered with an abrasive media, such as a 650 denier or coarser glass filament or strand, indicated by 18, grit or other media, so that as the glass filament 20 passes over this layered glass 18 or other abrasive media, the friction between the glass filament sliding over the layered glass of the roughening roller, causes the filaments to pick at each other or become abraded so as to cause a roughening of their surfaces, but not to the extent of unnecessarily breaking or splintering the unwinding glass filament 20. Other types of roughening elements or mechanisms also can be used in place of or in conjunction with the roller 17 for roughening the surface of the glass filament without breaking or splintering. For example, multiple rollers may be positioned along the path of the glass filament 20 in order to contact and roughen substantially all of the surface thereof. Alternatively, other roughening mechanisms, such as guides, tubes or sleeves having abrasive surfaces so as to scuff or abrade and thus roughen the smooth surface of the core filament also can be used.

Depending upon the type of glass and the denier of the glass on the roughening roller(s), if broken fibers are generated as the glass filament 20 is passed thereover, the amount of roughening being applied to the glass filament 20 can be varied by decreasing the diameter of the glass-coated roughening roller(s) and/or decreasing the tension of the glass filament 20 being pulled through the guides. Likewise, if the core is not being roughened enough to prevent slippage of the sheath yarns wound thereabout, larger roughening roller(s) wrapped with glass filament can be used and/or greater tension can be placed on the passing filament to increase the amount of roughening to which the glass filament 20 is exposed.

The filaments of the yarn cores of the present invention may also undergo another process step that may enhance both the feel and functionality, such as flexibility and the cut-resistance, of the resulting yarn. One or more of the core filaments, or the sheath fibers, may be subjected to a pre-stretching, stretch-breaking or precutting process. Stretch-breaking involves tensing the filament(s) with intent to elicit a change in the fiber structure. During tensing, the filament molecules may tend to align, the filaments tend to elongate, and weak portions of the filaments will tend to break. The resulting stretch-broken filaments generally are longer and stronger than they would have been otherwise and further generally have enhanced cut-resistance. At the same time, the stretch breaking of the core filaments provides enhanced bending and flexibility to the composite yarn by breaking up these high strength, typically rigid, less flexible filaments, and helps impart a softer hand to fabric in which they are incorporated. These enhanced properties over pre-cut, shorter length fibers are, at least partially, due to the presence of fewer gaps between fibers and better molecular orientation of the fibers than would otherwise be present, as well as elimination of at least some weak points in the finished fabric.

Figure 5:
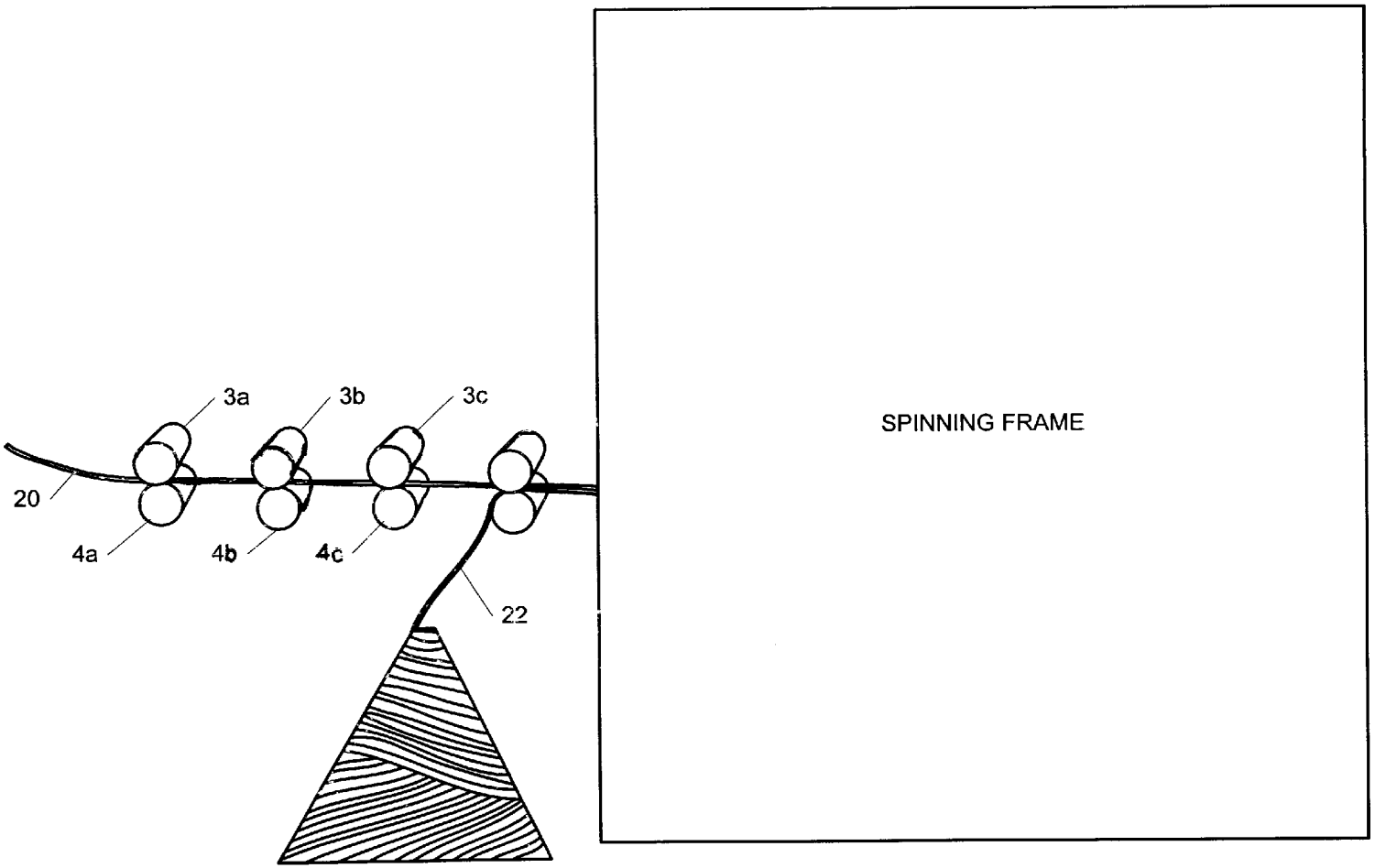
FIG. 5 is a side view of an assembly for producing a yarn that embodies the principles of the present invention.

As shown in FIG. 5, one or more filaments may be passed through a series of rollers during the stretch-breaking process. In the embodiment shown in FIG. 5, one of the filaments used to form the core, for example, the glass filament 20 or other filament such as an aramid filament, is subjected to the stretch-breaking process as it is being fed into the spinning frame, while the metal core filament 22 generally bypasses the stretch-breaking process. The spinning frame, a Dref3000 or similar/equivalent spinning frame generally will be provided with a series of roller sets including upper rollers 3*a*, 3*b*, 3*c* and bottom rollers 4*a*, 4*b* and 4*c* that are movable so as to enable the adjustment of the spacing between each set of rollers. Depending upon the desired a processing parameters, the top middle roller 3*b* can be completely removed in order to maximize the distance between rollers sets. Rollers 4*a*, 4*b*, 4*c* include a smooth outer surface, rather than a conventional grooved or bossed surface. The spacing and/or downward pressure of rollers 3*a*, 3*b*, 3*c*, are also adjustable so as to adjustably control the pressure applied to the glass filament 20.

As the filament 20 is fed into the first set of rollers 3*a* and 4*a*, the roller sets revolve at varying speeds with roller sets 3*b*/4*b* and/or 3*c*/4*c* revolving at a faster rate than roller set 3*a*/4*a*. The difference in roller speeds creates tension in synthetic filaments, such as the glass filament 20, thereby tending to cause the filament to break at weak points and/or elongate. The resulting broken filament will tend to be longer, due to stretching, and stronger, due to the breaking of weak points, than it was prior to being subjected to the stretch-breaking process. Therafter, the stretch broken fibers are generally longitudinally aligned with or along an additional core filament such as the metal filament and the composite core is then spun wrapped with the sheath fibers.

Even though FIG. 5 shows the stretch-breaking of a core filament as only a preliminary step in the yarn spinning process, the present invention also encompasses yarns and processes for making such yarns in which the core filaments are stretch-broken or are pre-cut independently of the spinning process. For yarns incorporating pre-stretch-broken fibers, the core filaments fed into the spinning frame may be fibers which have been previously stretch-broken and carded into slivers through a conventional carding process, such as, for example, a 3 cylinder conventional card, worsted card or roller top card system. These carded slivers may include substantially all stretch-broken fibers or blends also including conventional pre-cut synthetic or natural fibers.

Typically, while the metal filament 22 generally is not subjected to the stretch-breaking process depending on the inherent flexibility of the metal filament 22, however, it will be understood that the metal filament likewise could be stretch-broken or pre-cut as desired or needed, instead of or in addition to or in conjunction with the synthetic filament in a similar fashion. Indeed, yarns in which more than one or all of the core filaments are stretch-broken as they are fed into the spinning frame are also contemplated. Further, while stretch-breaking of the core filament(s) has been discussed, stretch-breaking of one or more sheath fibers is also contemplated. Stretch-broken sheath fibers may be processed into a sliver, as discussed above, and introduced into the spinning process through inlet rollers 7 of a Dref-3000 spinning frame or a similar spinning apparatus used to produce the yarns of the present invention.

Figure 6:
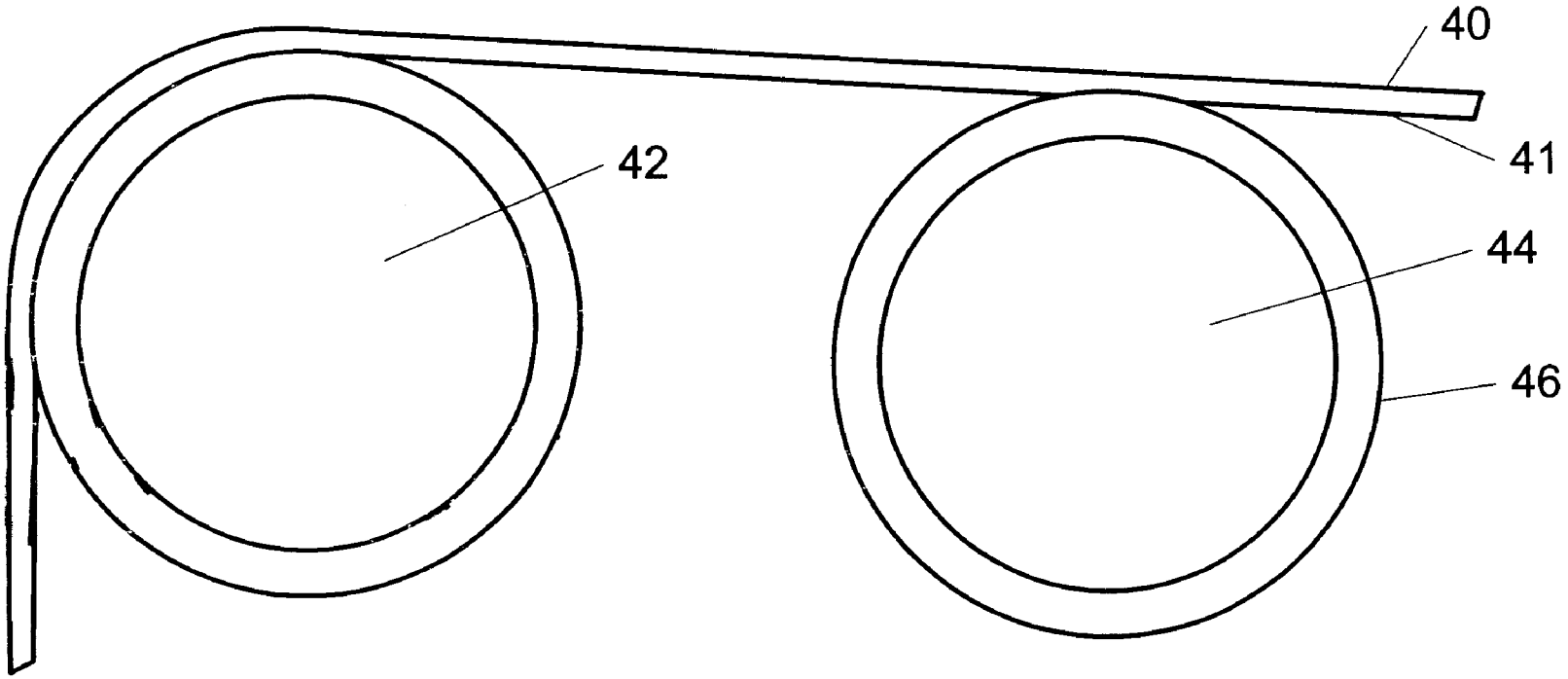
FIG. 6 is a side view of a section of an assembly for forming a yarn of the present invention, wherein a fiber is roughened.

One or more additional synthetic or natural filaments or fibers may also be included in the yarn core containing the glass and metal filaments. Such filaments or fibers may be formed from materials selected from aramids, acrylics, Basofil®, modacrylics, polyesters, high density polyethylenes, such as SPECTRA®, polyamides, liquid crystal polyester, polypropylenes, nylons, cellulosics, PBI, graphites, and other carbon-based fibers, co-polymers and blends thereof. These additional core filaments may range in thickness from about 20 denier to about 3,000 denier and can provide additional strength, cut-resistance, electrical dissipation or other properties or can act as filler for the yarn. As with the glass filaments, these additional polymeric core filaments or fibers 40 also can be stretch-broken and/or roughened in order to impart the characteristics described herein attributed to these processes. Such core filaments 40 may be stretch-broken by similar means as those used in the stretch-breaking of glass core filaments, while the roughening of these filaments 40 may be conducted in slightly different manner from those set forth for roughening glass and metal filaments. As shown in FIG. 6, such filaments or fibers 40 can be run over a first roller 42 and then run in contact with a second roller 44 having a roughened surface 46. The roughened surface 46 of second roller 44 may be formed of a glass, grit or other abrasive or textured material. The passing of filament 40 about first roller 42 can be done at approximately a ninety degree angle, or another appropriate angle, so as to not overly stress the filament 40 as it contacts second roller 44. In this manner, the filament 40 may be roughened, as shown by striations 41, so as to provide it with a greater coefficient of friction, while not unnecessarily weakening it.

Figure 7:
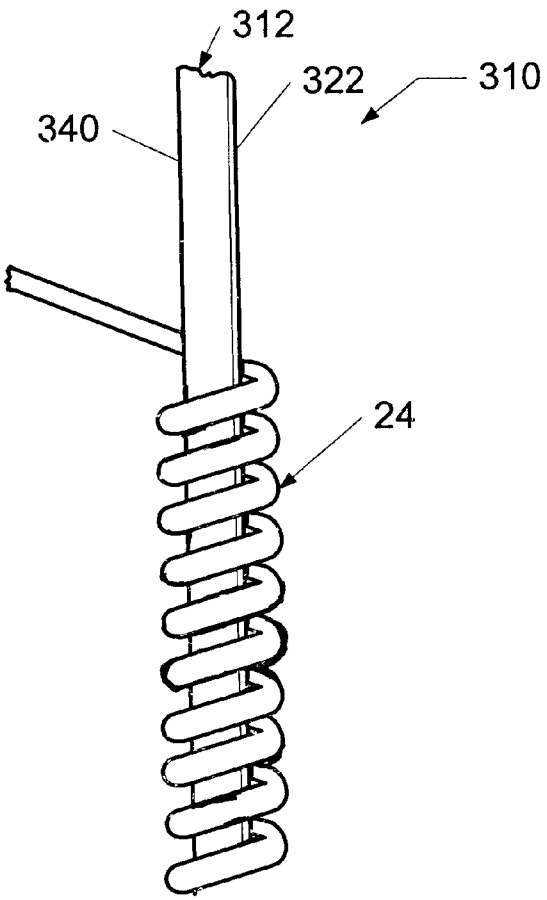
FIG. 7 is a side view of a section of yet another partially formed yarn embodying the principles of the present invention.

In certain circumstances, it is desirable to form a yarn embodying the principles of the present invention with a core not containing glass. As shown in FIG. 7, a yarn of the present invention may include a core 312 containing one or more metal filaments 322 and one or more nonmetallic filaments 340. The nonmetallic filaments or fibers 340 can be roughened, textured and/or stretch-broken according to the methods described herein. As shown in FIG. 7, the metal filament 322 may be significantly finer than nonmetallic filament 340, with the nonmetallic filament 340 generally ranging in thickness from about 20 denier to about 6,000 denier. Such nonmetallic filaments included in the core of this embodiment may be formed from materials selected from aramids, acrylics, melamine resins such as Basofil®, modacrylics, polyesters, polypropylenes, high density polyethylenes such as SPECTRA®, polyamides, liquid crystal polyester, nylon, rayon, silica, cellulosics, PBI, conductive fibers, graphites and other carbon-based fibers, co-polymers and blends thereof. These nonmetallic filaments may be stretch-broken and/or roughened according to the methods described hereinabove for other types of care and/or sheath fibers. The sheath 24 thereafter applied to the core of this embodiment generally will be formed of the same materials and be processed according to the same methods described herein for other sheaths.

In addition, the composite high performance yarn of the present invention can be used in fiber optics type applications. In such an application, core materials of high density polyethylenes such as SPECTRA®, which have sufficient strength required for fiber optics applications, can be used and wrapped with a melamine resin, such as Basofil®, a modacrylic, fire resistant rayon, or blends thereof, which has sufficient heat blocking properties as a first ply, with a second ply of a high tenacity polyester or similar material being wrapped in the same Basofil® or modacrylic fibers or fiber sheath material and being twisted therewith. As a result, the high density polyethylene is protected from the heat or temperatures that are generally required in the manufacture of fiber optic cables, while the use of the polyester and Basofil® and/or modacrylic blend sheath wrapping, cheapens the price of the resulting fiber optic material and further provides a rough or textured surface to enable technicians to grip and pull the fiber.

Figure 8:
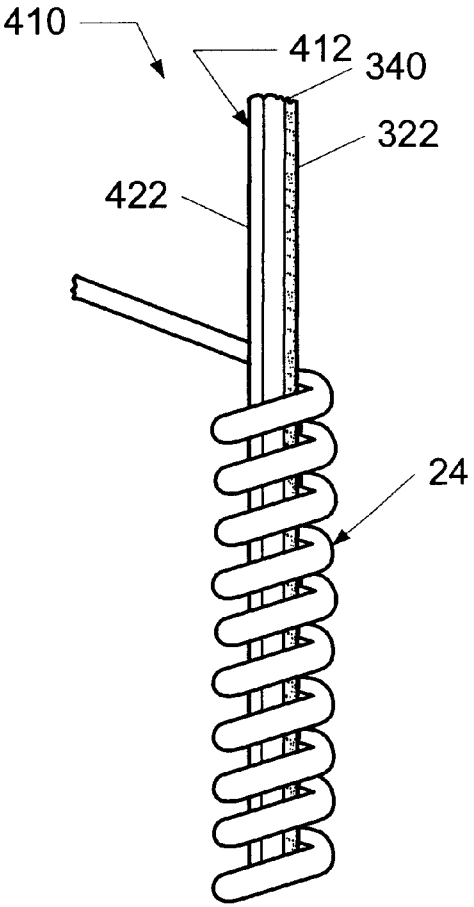
FIG. 8 is a side view of a section of still another partially formed yarn including multiple core filaments.

FIG. 8 shows a further embodiment 410 of the composite yarn of the present invention in which the core 412 of this yarn includes a first metal filament 322 and at least one additional secondary metal filament 422. The secondary metal filament 422 can be formed of the same metal as metal filament 322 or can be formed from another appropriate metal as circumstances dictate to impart a desired property or properties to the resultant composite yarns. Furthermore, the thickness of secondary metal filament 422 may be substantially the same or different from that of metal filament 322. The yarn 410 including secondary metal filament 422 is illustrated herein as one example of the alternative embodiments that are encompassed by the present invention. Indeed, other embodiments may include one or more polymeric or other synthetic filaments, such as indicated at 340, also incorporated into the core including at least one metal filament.

Figure 9A:
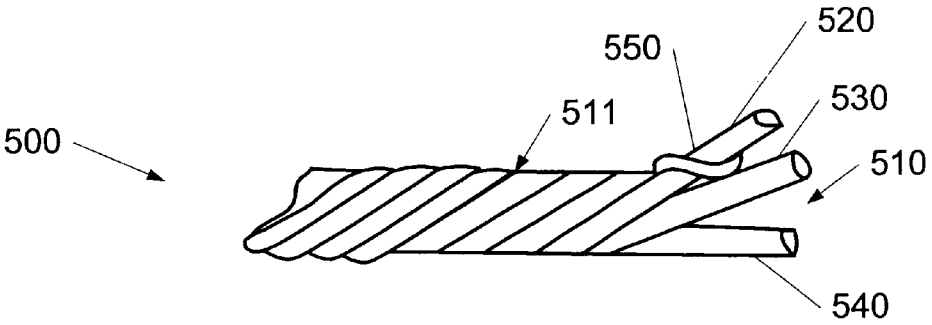
FIGS. 9A–9B are side views of a section of yarn having a core formed from multiple plies of yarns having cores of differing filaments.
Figure 9B:
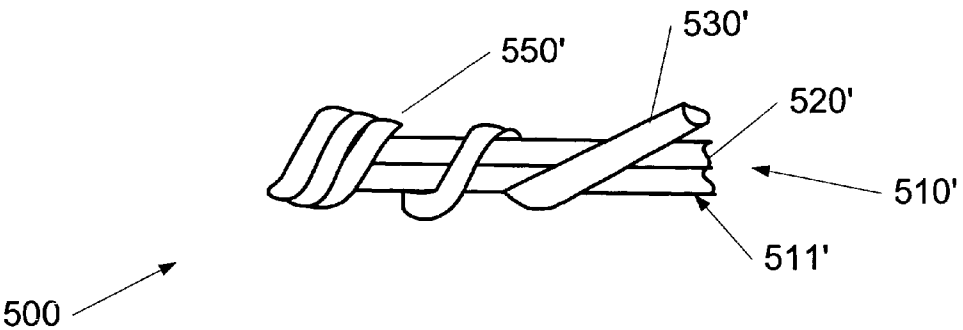

Still a further embodiment 500 of the present invention illustrated in FIGS. 9A–9B. In a first example shown in FIG. 9A, in which a composite yarn 510 includes a core 511 formed with a series of plies 520, 530 and 540 of various materials, each wrapped with a sheath of fibers 550. The first ply 520 can include an inorganic or organic glass or fiberglass core, the second ply 530 can include a metal core, such as steel, stainless steel, aluminum, copper, bronze, etc. While the third ply or core filament 540 can be a filler formed from a natural or synthetic material that adds additional softness and bulk at a relatively inexpensive cost. Alternatively, the third ply 540 can be a high performance, cut resistant material such as fibers or filaments selected from para-aramids, aramids, melamine resins such as Basofil®, modacrylics, polyesters, polypropylenes, acrylics, nylons, liquid crystal polyester, polybenzinidazole, high density polyethylenes, such as SPECTRA®, polyamides, and co-polymers and blends thereof, in another example embodiment 510' shown in FIG. 9B, the first ply 520' of the yarn 510' can include a combined glass and metal core 511' wrapped with a series of sheath fibers 550' and intertwined with at least one additional or second ply 530'. The second ply 530' can be formed from a high performance, cut resistant material, as discussed, wrapped with a fiber sheath. A third ply also can be added, typically including a filler material, if desired or needed according to the characteristics desired from the finished yarn/fabrics.

The multiple plies generally are individually wrapped with a fiber sheath 550 and are then intertwined or twisted, typically with an S-twist to form the composite or bundled yarn core 511/511'. The glass and or high performance cores or plies also can include roughened, textured, pre-cut, or stretch broken fibers or filaments.

The compositions of the yarns of the present invention may vary in order to optimize the desired characteristics of performance and economy. For example, if cut-resistance in the finished fabric is desired, then the yarn may include core filaments made of glasses, silicates, metals, aramids, liquid crystal polyester, or high density polyethylenes. If the yarn should be able to dissipate static electricity, then cores containing carbon filaments, alone or in combination with metal, such as steel or copper filaments, would prove useful. On the other hand, if fire resistance is to be a key feature of the finished fabric, then fiberglass, silicas, meta-aramids, steels, or other self-extinguishing fibers with a high limiting oxygen index (LOI) and combinations thereof would be appropriate components of the yarn cores. As illustrated, the present invention encompasses yarns of varied compositions.

In the various yarns of the present invention, a fiber or filament having a low melting point relative to the other fibers of the yarn, further may be included in the core and/or sheath in order to provide adhesive qualities to the finished yarn. During manufacture of the yarn, the yarn, or an intermediate portion thereof containing such a fiber with a low melting point, may be subjected to heat and/or pressure to cause the low melting point fiber to at least partially melt. As this fiber is at least partially melted, at least a part of its structure will tend to become amorphous and flow into the interstices of the yarn or intermediate yarn portion. Once the yarn, or intermediate, has cooled, the amorphous portion of the melted fiber will tend to solidify, thereby tending to adhere the fibers of the yarn, into a mass or consolidated portion. The resulting yarn will thus include a fiber that is at least partially amorphous. It is contemplated that the melted fibers may be contained in the core and/or the sheath.

Furthermore, the yarns of the present invention may include a counterclockwise, or S direction twist in order to reduce the frequency of occurrence of torqueing in the finished fabric or garment. As shown in FIGS. 1–3, 7 and 8 one or more of the fibers of the sheath may be wrapped about the core in the S direction. Likewise, although not shown, the filaments of the core may be wound about each other in the S direction. Twisting one or more yarn filaments in the S direction tends to significantly reduce and/or eliminate torqueing in the finished fabric or garment. By incorporating at least one core filament or sheath fiber twisted in the S direction into the yarn of the present invention, the twist multiple of the finished yarn becomes less important to the issue of fabric torqueing. Thus, the yarns of the present invention exhibiting a high twist multiple may be used to produce a smooth finished fabric or garment.

The yarns of the present invention are formed using a less expensive spinning process, typically carried out on a spinning frame, such as a Dref-2, Dref-3, Dref-2000, Dref-3000, Airjet, or conventional ring spinning frame, to form the core of the yarns and wrap the sheath fibers thereabout. In order to form yarns similar to that illustrated in FIG. 1, a glass filament is contacted with a metal filament to form the composite core. Typically, the glass and metal filaments are aligned or combined longitudinally, extending side-by-side, although the metal filaments also can be intertwined or twisted about the glass filaments as well. A sheath is wrapped about the core, with the wrapping of the sheath generally accomplished by winding or spinning one or more fibers individually about the core in the spinning frame. Also, one or more yarns forming the sheath may be applied to the core in a similar manner. Roughening and/or stretch-breaking may be conducted on one or more of the core filaments and/or sheath fibers according to the methods set forth herein. Spinning counts for yarns produced according to this method may be in the range of from about 0.6 ne to about 22 ne. The yarns also generally are produced on a Dref-2, Dref-3, Dref-2000, Dref-3000, Airjet, or conventional ring spinning frame, or similar spinning frame at speeds ranging from about 50 meters per minute to about 240 meters per minute, and typically at approximately 100–150 meters per minute.

In order to form a yarn similar to that illustrated in FIG. 7, the core of the yarn may be formed by contacting a metal filament, which further can be roughened as desired, with a synthetic filament in a manner similar to that set forth in forming a glass and metal core. The synthetic filament used to form the core also may be roughened as a preliminary step in the spinning process or may be roughened or textured independently of the spinning method.

The following examples are provided in order to illustrate aspects of the present invention, while in no way limiting the scope of thereof. Testing of the yarns formed according to the present invention versus conventionally available high performance, cut resistant yarns was conducted according to ASTM Standard Test Method for Measuring Cut Resistance Materials Used in Protective Clothing, ASTMF 1790–97, the disclosure of which is incorporated herein by reference.

The following sample yarns were prepared in accordance with the present invention:

EXAMPLE 1

6/2CC S Twist Ply—1End Knitted in a Glove

| | |
|---|---|
| cores | 1 ply 70 denier steel, 99 denier fiberglass<br>1 ply 400 denier SPECTRA |
| sheath | 90% para-aramid, 10% acrylic |
| cut resistance | 1113 corrected normalized load per ounce |

EXAMPLE 2

6/2CC S Twist N Ply—1 End Knitted in Glove

| | |
|---|---|
| cores | 1 ply 400 denier SPECTRA, 99 denier fiberglass<br>1 ply 400 denier SPECTRA, 99 denier fiberglass |
| sheath | 90% para-aramid blend, 10% acrylic |
| cut resistance | 981 corrected normalized load per ounce |

EXAMPLE 3

6/2CC S Twist N Ply—1 End Knitted in Glove

| | |
|---|---|
| cores | 1 ply 99 denier fiberglass, 7 denier steel<br>1 ply 99 denier fiberglass, 70 denier steel |
| sheath | 90% para-aramid blend, 10% acrylic |
| cut resistance | 1168 corrected normalized load per ounce |

EXAMPLE 4

6/2CC S Twist N Ply—1 End Knitted in Glove

| | |
|---|---|
| cores | 1 ply 70 denier steel, 99 denier fiberglass<br>1 ply 150 denier textured polyester |
| sheath | 90% para-aramid, 10% acrylic |
| cut resistance | 924 corrected normalized load per ounce |

EXAMPLE 5

6/2CC S Twist N Ply—1 End Knitted in Glove

| | |
|---|---|
| cores | 1 ply 400 denier SPECTRA, 70 denier steel<br>1 ply 400 denier SPECTRA, 70 denier steel |
| sheath | 90% para-aramid, 10% acrylic |
| cut resistance | 968 corrected normalized load per ounce |

The 70 denier steel used for these test yarns was a bekaert 0.035 mm stainless steel filament. Corrected normalized load per ounce is measured as: normalized load of 1 inch/weight for 2 inch×4 inch sample. Each of the yarns knitted into a prototype glove was compared to three existing conventional "Tuff-Knit" Kevlar protective gloves. These included the following:

| | |
|---|---|
| Comparator 1 | 100% Kevlar, 20 oz. loop in terrycloth "Tuff-Knit KV Extra," product no. TKV24XJ-50KV, cut resistance of 393 corrected normalized load per ounce; |
| Comparator 2 | 100% Kevlar, standard weight yellow "Tuff-Knit KV," product no. KV18A-100, cut resistance of 386 corrected normalized load per ounce; and |
| Comparator 3 | 100% Kevlar, heavyweight yellow "Tuff-Knit KV," product no. KV20AL-100, having a cut resistance of 380 corrected normalized load per ounce. |

The following Table I summarizes the results of these comparisons, showing the significant differences in cut resistance per ounce achieved by the present invention versus conventional 100% Kevlar protective gloves.

TABLE I

| | Measured in corrected normalized load per ounce according to ASTM F1790-97 Standards |
|---|---|
| Example 1 | 1113 |
| Example 2 | 981 |
| Example 3 | 1168 |
| Example 4 | 924 |
| Example 5 | 968 |
| Comparator 1 | 393 |
| Comparator 2 | 386 |
| Comparator 3 | 380 |

It will be understood by those skilled in the art that while the present invention has been discussed above with respect to certain embodiments, various modifications, additions, and changes can be made thereto without departing from the spirit and scope of the invention as set forth in the following claims.

What is claimed is:

1. A yarn comprising:

a core including at least a glass component formed from stretch-broken or cut fibers and a metal filament adjacent said glass component; and, at least one sheath applied to said core.

2. The yarn of claim 1, wherein said core further includes a synthetic fiber, selected from the group consisting essential of aramids, acrylics, melamine resins, conductive filaments, rayon, silica, liquid crystal polyester, modacrylics, polyesters, polypropylenes, nylons, cellulosics, polybenzimidazole, graphites, co-polymers and blends thereof.

3. The yarn of claim 1, wherein said core further includes a first ply formed from said glass component and said metal filament and a second ply of a cut resistant material.

4. The yarn of claim 3, and wherein said core further includes a third ply formed from a filler material.

5. The yarn of claim 3, wherein said second ply includes at least one fiber formed from a material selected from the group consisting essentially of aramids, acrylics, melamine resins, conductive filaments, rayon, silica, liquid crystal polyester, modacrylics, polyesters, polypropylenes, high density polyethylene, nylons, cellulosics, polybenzimidazole, graphites, co-polymers and blends thereof.

6. The yarn of claim 3 and wherein the yarn plies are twisted in an S direction.

7. The yarn of claim 3 and wherein said first and second plies are each wrapped individually with said sheath and are twisted to a yarn bundle.

8. The yarn of claim 1, wherein said sheath comprises a fiber including a material selected from the group consisting essentially of aramids, acrylics, melamines, modacrylics, polyesters, polypropylenes, nylons, cellulosics, silica, graphites, carbon fibers, high density polyethylene, polyamides, metals, polybenzimidazole, co-polymers and blends thereof.

9. The yarn of claim 1, wherein said sheath comprises at least one fiber which is at least partially amorphous.

10. The yarn of claim 1, wherein said metal filament includes a material selected from the group consisting essentially of steel, stainless steel, aluminum, copper, bronze and alloys thereof.

11. The yarn of claim 1, wherein said sheath fiber is wound about said core in a S direction.

12. The yarn of claim 1 and wherein a portion of said glass fibers are roughened.

13. A fabric comprising at least one yarn of claim 1.

14. A yarn comprising:

a core including at least a roughened glass filament and a metal filament; and, a sheath applied to said core.

15. The yarn of claim 14, said core comprises a series of plies including a first ply formed from said glass filament and said metal filament, and a second ply comprising a cut resistant material.

16. The yarn of claim 14, wherein said sheath includes a stretch-broken fiber.

17. The yarn of claim 14, wherein said sheath is wound in the S direction.

18. The yarn of claim 14 and wherein said sheath includes a blend of stretch broken synthetic fibers aligned along said core filament.

19. The yarn of claim 14, wherein said sheath comprises a fiber selected from the group consisting essentially of aramids, acrylics, melamines, modacrylics, polyesters, liquid crystal polyester, rayon, silica, conductive filaments, polypropylenes, nylons, cellulosics, polybenzimidazole, graphites, carbon fibers, high density polyethylenes, polyamides, metals, co-polymers and blends thereof.

20. The yarn of claim 14, wherein said sheath includes filament that is at least partially amorphous.

21. A fabric comprising a yarn of claim 14.

22. A method for producing a yarn comprising:

contacting a glass filament with a metal filament to form a core; roughening at least one of the glass filament and the metal filament; and wrapping the core with at least one sheath fiber.

23. The method of claim 22, further including spinning at least one fiber of the sheath in a S direction.

24. The method of claim 22, further including stretch-breaking a fiber of the sheath.

25. The method of claim 22, wherein the metal filament includes a material selected from the group consisting essentially of steel, stainless steel, aluminum, copper, bronze and alloys thereof.

26. The method of claim 22, further including contacting at least one of the glass filament and metal filament with a second ply including at least one fiber selected from the group consisting essentially of aramids, acrylics, melamines, modacrylics, polyesters, liquid crystal polyester, polypropylenes, nylons, cellulosics, silica, graphites, carbon fibers, high density polyethylenes, polyamides, metals, polybenzimidazole, co-polymers and blends thereof.

27. The method of claim 26, wherein said sheath includes at least one fiber selected from the group consisting essentially of aramids, acrylics, melamines, modacrylics, polyesters, polypropylenes, nylons, cellulosics, polybenzimidazole, graphites, carbon fibers, high density polyethylenes, polyamides, metals, co-polymers and blends thereof.

28. The method of claim 22, further including at least partially melting a portion of the yarn.

29. The method of claim 22, wherein the metal filament includes stainless steel.

30. A yarn comprising:

a core including a longitudinal first filament surrounded by a series of stretch broken fibers, extending longitudinally along, and aligned with said longitudinal filament, wherein at least one of the longitudinal first filament or stretch broken fibers is roughened, and a cylindrical sheath wrapped about said core.

31. The yarn of claim 30 wherein the stretch broken fibers of the core are selected from the group consisting essentially of aramids, acrylics, melamine resins, modacrylics, polyesters, polypropylenes, nylons, silica, rayon, graphite, carbon fibers, high density polyethylene, liquid crystal polyester, metals, polybenzimidazole, co-polymers and blends thereof.

32. The yarn of claim 31 wherein the stretch broken fibers are blended with natural fibers comprising, but not limited to, cotton, wool, jute, and linen.

33. The yarn of claim 30 wherein the stretch broken fibers comprise precut and carded steel fibers or blends of fibers containing metal.

34. The yarn of claim 30 wherein the sheath fibers are selected from the group consisting essentially of aramid, acrylic, melamine resins, modacrylic, polyester, polypropylenes, nylons, cellulosics, silica, graphite, carbon fibers, high density polyethylene, rayon, metals, polybenzimidazole, co-polymers, and blends thereof.

35. The yarn of claim 30 and wherein said longitudinal filament includes at least one metallic filament in said core.

36. The yarn of claim 30 wherein said longitudinal filament of said core is elastic.

37. The yarn of claim 30 and wherein said core includes at least one pre-spun yarn selected from the group consisting essentially of aramids, acrylics, polyesters, high density polyethylene, silica, fiberglass, graphite, carbon fibers, metals, rayon, copolymers, polybenzimidazole.

38. The yarn of claim 30 wherein said roughened surface is mechanically abraded.

39. The yarn of claim 30 wherein said roughened surface is chemically abraded.

40. The yarn of claim 30 wherein at least one of the longitudinal filaments or stretch-broken fibers of said core has been melted.

41. A yarn, comprising:

a core including at least a glass filament that is broken or cut, and a metal filament adjacent said glass filament; and a sheath component applied along said core.

42. The yarn of claim 41, wherein said core further includes a synthetic filament, selected from the group consisting essential of aramids, acrylics, melamine resins, conductive filaments, rayon, silica, liquid crystal polyester, modacrylics, polyesters, polypropylenes, nylons, cellulosics, polybenzimidazole, graphites, co-polymers and blends thereof.

43. The yarn of claim 41, wherein said sheath comprises a fiber including a material selected from the group consisting essentially of aramids, acrylics, melamines, modacrylics, polyesters, polypropylenes, nylons, cellulosics, silica, graphites, carbon fibers, high density polyethylenes, polyamides, metals, polybenzimidazole, co-polymers and blends thereof.

44. The yarn of claim 41 and wherein the yarn plies are twisted in an S direction.

* * * * *